US012127718B1

(12) United States Patent
Linyard

(10) Patent No.: US 12,127,718 B1
(45) Date of Patent: Oct. 29, 2024

(54) HEIGHT-ADJUSTABLE INDEPENDENT FOOTRESTS TO REDUCE TOILET STRAINING AND METHOD OF USE

(71) Applicant: Grayson Lee Linyard, Dallas, TX (US)

(72) Inventor: Grayson Lee Linyard, Dallas, TX (US)

( * ) Notice: Subject to any disclaimer, the term of this patent is extended or adjusted under 35 U.S.C. 154(b) by 5 days.

(21) Appl. No.: 18/608,934

(22) Filed: Mar. 19, 2024

(51) Int. Cl.
*A47K 17/02* (2006.01)

(52) U.S. Cl.
CPC ..... *A47K 17/028* (2013.01)

(58) Field of Classification Search
CPC ..... A45D 29/18–20; A47C 12/00–02; A47C 16/00–025; A47C 31/003; A47C 7/52; A47K 17/00–028; A47K 2017/006; A47K 2201/00–025; A47K 3/125
See application file for complete search history.

(56) References Cited

U.S. PATENT DOCUMENTS

| | | | | |
|---|---|---|---|---|
| 7,814,581 | B1 * | 10/2010 | Willner | A47K 17/02 D6/349 |
| 10,143,343 | B1 * | 12/2018 | Miller, Sr. | A47K 17/024 |
| 10,959,582 | B2 * | 3/2021 | Nethercott | A47K 17/028 |
| 2017/0027331 | A1 * | 2/2017 | Jensen | A47K 17/028 |

FOREIGN PATENT DOCUMENTS

| | | | | |
|---|---|---|---|---|
| JP | 3426567 | * | 7/2003 | A47K 17/024 |
| KR | 20070110819 | * | 11/2007 | A47K 17/022 |
| WO | WO2014118486 | * | 8/2014 | A47C 31/003 |

OTHER PUBLICATIONS

"Stuul". Jun. 8, 2023. <https://web.archive.org/web/20230608111133/https://stuul.com/en-us> (Year: 2023).*
"Evron Toilet Stool". Dec. 10, 2016. <https://www.amazon.com/Evron-Stackable-Bathroom-Squatting-Assistance/dp/B01MQUEYX8/> (Year: 2016).*

* cited by examiner

*Primary Examiner* — David P Angwin
*Assistant Examiner* — Nicholas A Ros

(57) ABSTRACT

A device to avoid straining while sitting on a toilet, and method of use. The device is comprised of two independent rectangular blocks, and each block can be independently positioned on the floor and adjusted to one of three heights by rotation. Each block can be connected to the toilet tank or wall surrounding the toilet for storage and ease of access once seated. The method comprises the steps of sitting on the toilet, disengaging the blocks from their connections on the toilet tank or wall surrounding the toilet, placing the blocks on the floor at the user's desired location and desired block height by rotation, placing the user's feet on top of the blocks, and returning the blocks to their storage location.

1 Claim, 3 Drawing Sheets

HEIGHT-ADJUSTABLE INDEPENDENT FOOTRESTS TO REDUCE TOILET STRAINING AND METHOD OF USE

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

STATEMENT REGARDING PRIOR DISCLOSURES BY THE INVENTOR OR A JOINT INVENTOR

None.

BACKGROUND OF THE INVENTION

(1) Field of the Invention

The field of the invention is stools and footrests for use when using a toilet to improve toilet posture and reduce straining, and methods of use.

(2) Description of Related Art Including Information Disclosed Under 37 C.F.R. 1.97 and 1.98

Various forms of footrests and stools for use in improving toilet posture have been patented. For example, U.S. Pat. No. 7,814,581B1 discloses a box-shaped footrest for both feet placed in front of a toilet. U.S. Pat. No. 6,681,410B1 discloses another type of footrest for use with a toilet. Independent footrests for each foot to use with a toilet have also been disclosed, for example U.S. Pat. No. D785,351S1 and U.S. Pat. No. D705,554S1. Finally, at least one height-adjustable toilet footrest has also been patented in recent years: US20150327739A1.

However, none of the prior art disclose footrests for use with a toilet that are (a) independent footrests, (b) easily and independently height adjustable, (c) easily stored above the the floor to avoid tripping hazards and contamination from other users and toilet overflow, and (d) stored via connection to the toilet tank or surrounding walls, so that the footrests can be easily accessed, and put away, once the user is already seated on the toilet. The present invention solves these issues.

BRIEF SUMMARY OF THE INVENTION

A device for use in improving posture to avoid straining while sitting on a toilet, and method of using such device.

The device is comprised of two independent rectangular blocks and means for connecting each block to the toilet tank or wall surrounding the toilet. The rectangular blocks can be independently positioned on the floor to fit each user. Each block has sides of three differing lengths, such that each block is easily adjusted to one of three heights by rotating the block such that a different face of the block is resting against the floor. Each block has connective means such that it can be connected to the toilet tank or wall surrounding the toilet for storage and ease of use. This allows the device to remain out of the way of other toilet users who do not wish to use it, above the floor to avoid a tripping hazard or contamination from users or toilet overflows, and in a convenient location where the user can easily take the blocks from their storage location and return them all while seated, without needing to bend over. The method comprises the steps of sitting on the toilet, disengaging the blocks from their connective means on the toilet tank or wall surrounding the toilet, placing each block at the user's desired location and desired block height, placing the user's feet on top of the blocks while using the toilet, and returning the blocks to their storage location via the connective means.

DETAILED DESCRIPTION OF THE INVENTION

Figure 1:
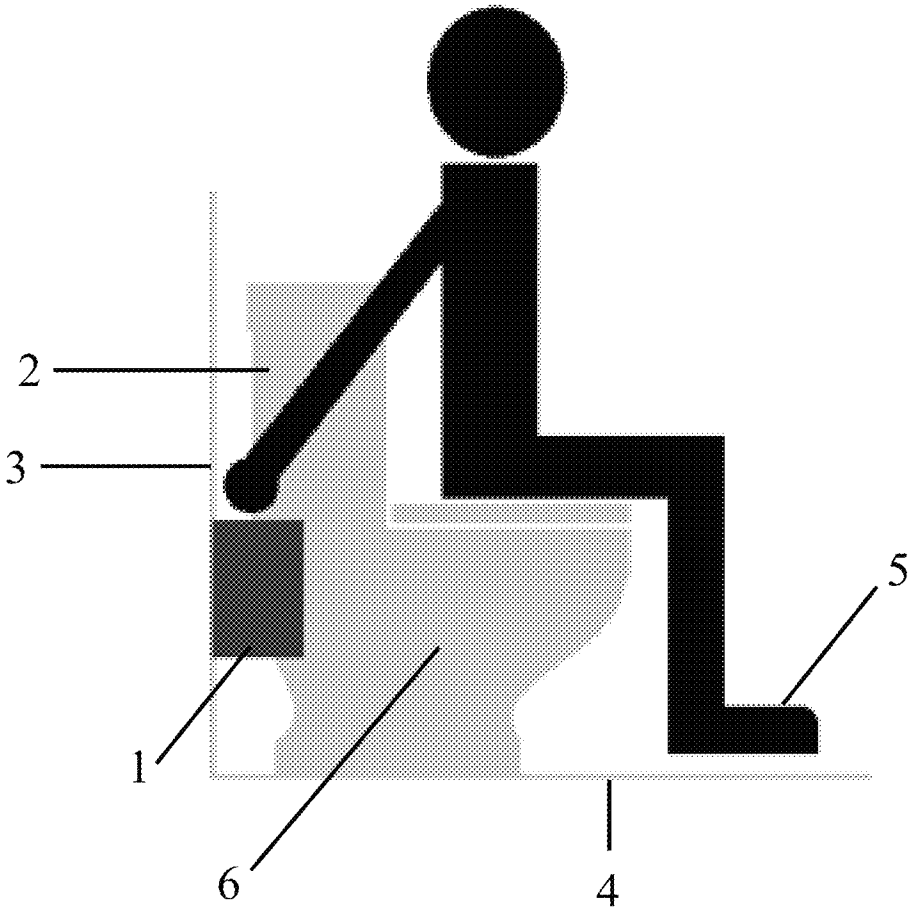
FIG. 1 shows how a user can easily access the blocks for use after being seated on the toilet, and return the blocks to their storage locations while seated on the toilet.
Figure 2:
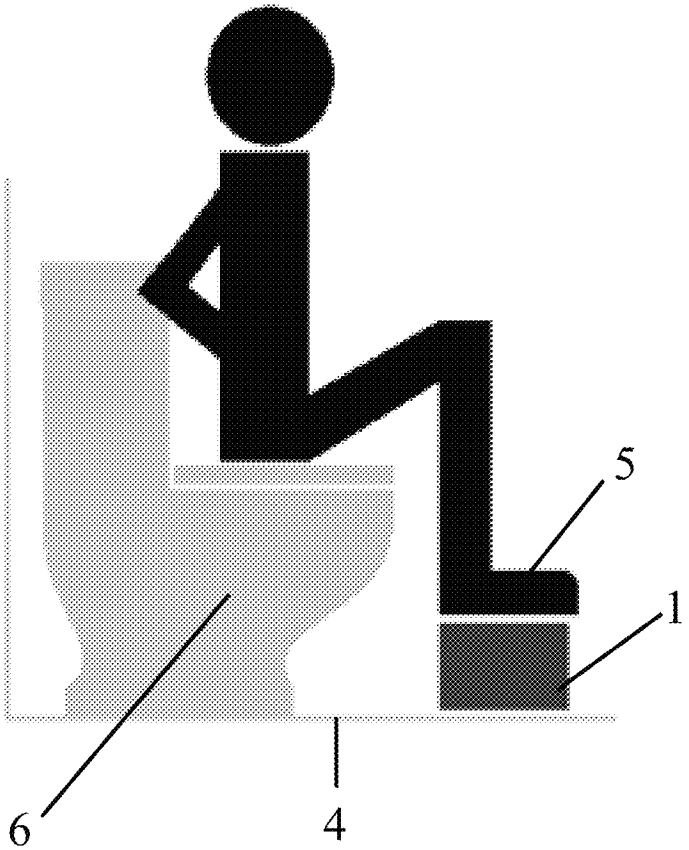
FIG. 2 shows the blocks in use while the user is seated on the toilet.
Figure 3:
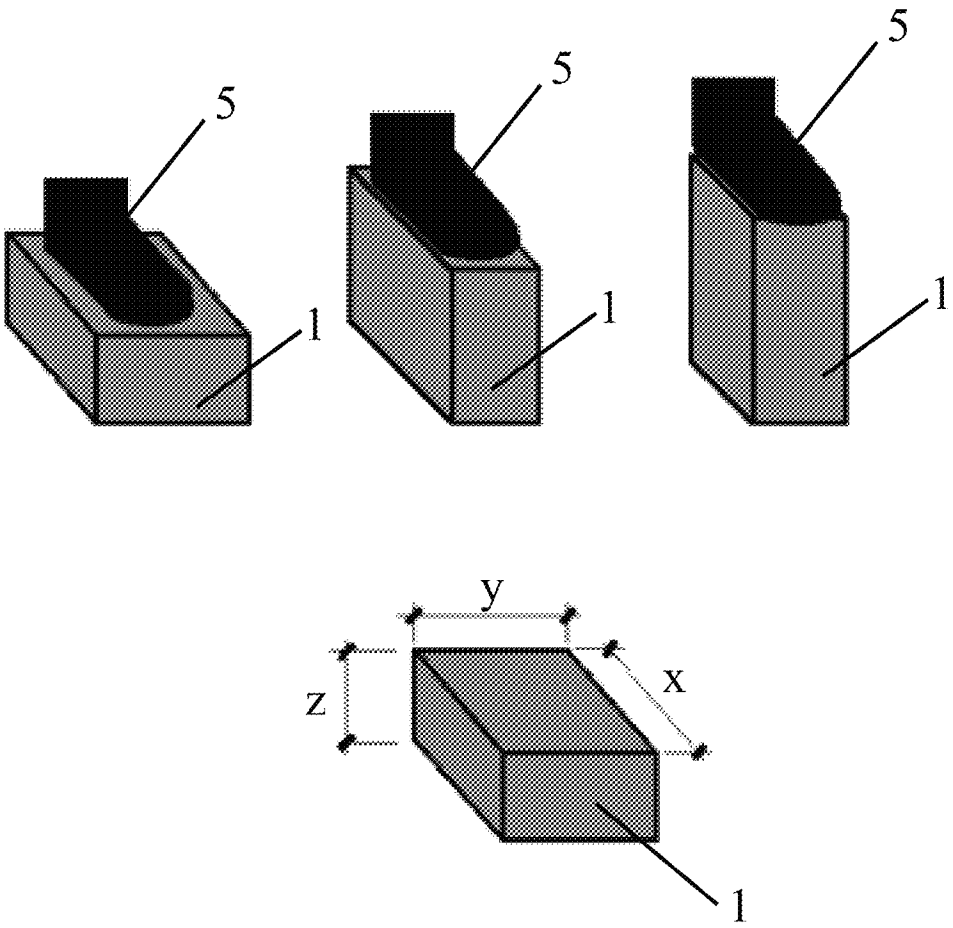
FIG. 3 shows a block with three sides of three differing lengths, that can be configured to three different heights via rotation, and examples of a user's foot on top of a block in each of its three possible heights.

In the present preferred embodiment of the device, the device is comprised of two independent rectangular blocks (1), each with three sides of differing lengths (x, y, z) and connective means such that the blocks (1) can be connected to the toilet tank (2) or wall surrounding the toilet (3) for storage and ease of use. Each rectangular block can be independently positioned on the floor (4) to fit each user at their desired location. This allows the device to fit precisely to all users of differing heights and body shapes, allowing the user to freely and easily adjust where they place their feet (5) while sitting on a toilet (6). For example, the device is easily configured to a user who has a wide stance or a narrow stance. It can be configured to users who prefer their feet towards the back of the toilet, as well as those who prefer their feet out in front of the toilet. The present invention even allows for a user to place their feet in a non-symmetrical manner, such as one foot in front of the other or one foot out wide. Current stools that are continuous between both footrests (e.g., concave to fit the front of the toilet) and not independent to each foot fail to achieve this customizability for each user.

Each block has at least three sides of differing lengths (x, y, z), such that the block can be placed on the floor and rotated to one of three heights, depending upon which face of the block is resting against the floor. In the present preferred embodiment, the rectangular blocks have dimensions of approximately nine inches (x) by six inches (y) by four inches (z). The three differing dimensions allow a user to quickly and easily adjust the height of each block to one of the three heights via rotation, without the need to tinker with push-pins or other height adjustments. This also allows the height of each block to be different for each foot, depending upon the user's preference. The current art fails to disclose independent footrests that are easily height adjustable via rotation, including to differing heights for each footrest.

In the present preferred embodiment, the blocks are made of hard foam or plastic so that they are lightweight and easy for the user to manipulate, while still being sturdy enough to take the weight of an adult while in use. The lightweight nature of the blocks also allows them to be used with a wide variety of connective means, such as magnets.

Each block has connective means such that it can be connected above the floor to the toilet tank (2) or wall surrounding the toilet (3) for storage and ease of use. One limitation of the current art is that the disclosed toilet stools and footrests are not easily stored out of the way of other users (which presents a tripping hazard or the users having to avoid the stool when standing near the toilet or sitting down on it). Another limitation of the current art is that the disclosed toilet stools and footrests are designed and intended to rest on the floor when not in use, which presents not only a tripping hazard, but also a less sanitary device, because any stool or footrest on the floor by the toilet is more prone to unsanitary contamination via users and in the event of a toilet overflow. The solution is independent blocks that can easily be stored out of the way of other users and above the floor via the use of connective means connecting the blocks to the toilet tank or the wall surrounding the toilet.

Connecting the blocks above the floor to the toilet tank or wall surrounding the toilet also improves upon the prior art by storing the blocks in a location that is easily accessible to a user once seated, allowing the user to: sit down on the toilet first with no obstructions, disengage the blocks from the connective means while seated, use the blocks, and return the blocks to their storage location via the connective means while seated. This avoids the need for the user to bend over from a standing position when accessing or storing the blocks.

The present preferred embodiment of the connective means is via magnetic means. This allows a user to easily connect and disconnect each block from its storage location without the need to view the connection when doing so. This allows the user to connect and disconnect the block from the connective means while seated on the toilet by simply reaching backward, without having to look backwards or bend/twist down to see connection when doing so.

One example of such magnetic means for each block is a magnet affixed to the toilet tank or the wall around the toilet via an adhesive or tape, and a thin ferrous plate affixed to the outside of the block via an adhesive. The ferrous plate could also be integrated into the foam of a foam block or inside the plastic of a plastic block. The block is then placed such that the ferrous plate is held in place by the magnet on the wall or toilet tank. The result is a secure connection holding the block in place above the floor and out of the way, while still in reach of user seated on the toilet. The user can reach the blocks while seated, and can easily connect or disconnect the blocks while seated and without needing to view the connection or bend over from a standing position. While the present preferred embodiment of the connective means is magnetic, other connective means could be used, including but not limited to clip(s), clamp(s), hook(s), loop(s), ring(s), or Velcro.

The disclosed method comprises the steps of sitting on the toilet, disengaging the blocks from their connective means on the toilet tank or wall surrounding the toilet, placing the blocks at the user's desired location and block height, placing the user's feet on top of the blocks while using the toilet, and returning the blocks to their storage location via the connective means while still seated.

The disclosed method keeps the blocks out of the way of all toilet and bathroom users until the blocks are used (if desired). Some bathrooms have limited space, and a toilet stool or footrest that remains on the floor in front of or beside the toilet limits the ability to move around in the bathroom. Moreover, if a user does not wish to sit down on the toilet or use the device, other toilet stools or footrests present a tripping hazard during use of the toilet, and can present an obstacle when sitting down or getting up from the toilet. Additionally, toilet stools and footrests that remain on the floor by the toilet present a risk of unsanitary contamination from other users and in the event of toilet overflow. Additionally, toilet stools and footrests can present an eyesore in front of a toilet. The present method solves these issues by keeping the blocks stored above the floor, and in a place that is out of the way of other toilet users, while still being easily used by those who desire to do so.

The disclosed method allows blocks to be easily accessed and returned to their storage location while seated. This allows the first step of the method to be sitting on the toilet, without the need to set up a stool or footrests, and without the need to avoid a stool or footrests while sitting down on the toilet. The method also allows the user to adjust the blocks to fit their body type, by allowing the user to independently position the blocks, and to easily adjust the height of each block independently via rotation.

SEQUENCE LISTING

Not Applicable.

The invention claimed is:

1. A method of using a device to elevate one's feet while sitting on a toilet, wherein said device comprises: two independent rectangular blocks; wherein each block can be freely positioned on the floor near the toilet bowl at the user's desired location, wherein each block can be rotated to stand at three different heights depending upon which face of the rectangular block is resting flat against the floor; and wherein each block is stored by using magnetic means to removably connect each block to the toilet tank or wall surrounding the toilet at a location that is above the floor;

the method comprising the steps of:

a. first, sitting down on the toilet;

b. second, while the user is sitting on the toilet, disengaging the blocks via the magnetic means from the toilet tank or wall surrounding the toilet;

c. third, placing each block on the floor by the toilet bowl at the user's chosen location and block height;

d. fourth, placing the user's feet on top of the blocks while using the toilet; and e. fifth, while the user is still seated on the toilet, returning each block to its storage location on the toilet tank or wall surrounding the toilet by re-engaging the magnetic means.

* * * * *